United States Patent [19]

Simelunas et al.

[11] Patent Number: 4,578,930

[45] Date of Patent: Apr. 1, 1986

[54] YEAST CAKE LOADING DEVICE

[75] Inventors: William J. Simelunas, Glen Rock; Agostino Aquino, Paterson; Nicholas R. Polifroni, Cliffside Park, all of N.J.

[73] Assignee: Nabisco Brands, Inc., Parsippany, N.J.

[21] Appl. No.: 606,010

[22] Filed: May 2, 1984

[51] Int. Cl.[4] ..... B65B 35/30

[52] U.S. Cl. ..... 53/534; 53/251; 53/255; 53/262

[58] Field of Search ..... 53/247, 248, 250, 251, 53/255, 260, 262, 531, 534, 535; 414/86, 89, 110

[56] References Cited

U.S. PATENT DOCUMENTS

| | | | |
|---|---|---|---|
| Re. 25,852 | 9/1965 | Nigrelli et al. | 53/247 X |
| 3,410,387 | 11/1968 | Wennberg et al. | 198/429 |
| 3,470,674 | 10/1969 | Madonia | 53/251 X |
| 3,599,397 | 8/1971 | Standley et al. | 53/534 X |
| 3,601,952 | 8/1971 | Cato | 53/534 X |
| 3,669,283 | 6/1972 | Brown, Jr. | 198/403 |
| 3,837,466 | 9/1974 | Jones | 198/429 |
| 3,866,392 | 2/1975 | Weeks et al. | 53/534 |
| 3,923,144 | 12/1975 | Langen | 198/429 |
| 4,141,193 | 2/1979 | Joa | 198/408 |
| 4,214,655 | 7/1980 | Bernham et al. | 198/403 |
| 4,274,532 | 6/1981 | Johnson | 198/429 |
| 4,300,420 | 11/1981 | Haenni | 410/110 X |

FOREIGN PATENT DOCUMENTS

| | | | |
|---|---|---|---|
| 2831248 | 1/1980 | Fed. Rep. of Germany | 414/86 |
| 670611 | 4/1952 | United Kingdom | 53/535 |
| 712668 | 7/1954 | United Kingdom | 53/162 |

*Primary Examiner*—John Sipos
*Assistant Examiner*—Steven P. Weihrouch
*Attorney, Agent, or Firm*—Richard Kornutik

[57] ABSTRACT

A yeast cake loader loads yeast cakes into shallow open-top boxes in a reciprocating motion. The yeast cakes are smoothly lowered by a resiliently bendable surface which resiliently bends under the weight of the yeast cakes during loading. A ram pushes a block of yeast cakes across the resiliently bendable surface, which operates to move the box as well. When the box is full and has been moved a distance of one box width, the ram retracts and a new box is supplied under the resiliently bendable surface. The resiliently bendable surface then returns to its initial position. Additional yeast cakes are supplied in front of the ram, and the cycle is repeated.

26 Claims, 11 Drawing Figures

YEAST CAKE LOADING DEVICE

BACKGROUND OF THE INVENTION

This invention relates to a loading device for loading discrete yeast cakes, and particularly to a loading device for loading discrete yeast cakes into a container in such manner that the yeast cakes lie in uniform rows and columns and with the lower surfaces of the yeast cakes all lying flat against a generally planar bottom support surface of the box, without damage to corners or edges of the yeast cakes.

This yeast cake loading device may also be adapted for use as a loader for any regular, rectangular, prismatic solid discrete objects, for example, boxes containing any product, bricks, blocks, construction toy elements having regular rectangular prismatic shapes, regular rectangular prismatic elements used in assembly work for assembly into final products, as well as non-rectangular objects which have contact surfaces such that discrete rows can be defined along some line and which are stable against any vertical upward movement during operation of the loading device.

It is well-known to load regular rectangular prismatic articles into boxes in such as way as to achieve a densest packing arrangement. In this densest packing arrangement, the entire volume of a container is filled by abutting rows and columns of the regular rectangular prismatic solids. In the case of bricks, for example, uniform bricks are arranged side by side such that the lower surfaces on each brick in a particular level in the box lie generally along a given plane; adjacent bricks have contacting sides such that no gap is left between adjacent bricks. Such loading is commonly performed manually by workers at an assembly line having a conveyor belt or other arrangement for moving the product to be loaded into a larger receptacle. In another arrangement, complex devices are used to grasp an entire row or column of the discrete regular rectangular prismatic articles and bodily transport them as a single row or column into the receptacle. In a still further type of known device, machinery is used to transport the discrete regular rectangular prismatic articles already arranged in rows and columns and push the articles into an open carton or other receptacle without any change in elevation of the articles.

The prior art loading devices as described above, have several drawbacks. In the first type, it is the cost of the complex equipment used to perform the loading operation. The cost is both in the initial capital investment to acquire the equipment, as well as to keep the complex equipment maintained and to replace parts which wear out or are damaged. In addition, in physically transporting entire rows or columns of the product by applying force along opposing end surfaces of end articles of the respective rows or columns, the individual articles must be sufficiently strong in compression as to withstand the force applied necessary to keep the weight of the row or column from causing downward displacement of individual articles and thereby causing failure of the loading device. In particular, in the case of yeast cakes which are relatively weak in compression and tend to crumble, such a loading device is impractical.

The second type of loading device discussed above can in principle have a relatively simple arrangement of a conveyor belt, open receptacle, and a pusher rod for pushing an entire discrete set of rows and columns of the articles into the container. This is suitable in the case of relatively massive articles in which differences in the coefficients of friction along the underside of each individual article do not cause rotation of the articles since the articles have a relatively great inertia and the distance to be traveled is generally small. Such rotation, even a relatively small amount of rotation, of each individual article would cause a misalignment of at least an individual article thereby causing an interference between an upstanding sidewall of the container and the intended direction of travel of the article. This would result in a misfeed. Thus, in the case of a relatively very light article such as a yeast cake, slight misalignments could occur very easily, since yeast cakes have a relatively low inertia and would not tend to resist rotation as well as much heavier objects would. Furthermore, the success of the prior art loading device of this type requires that a preformed box having four connected sides and open bottom and top ends be employed. Therefore, if a container is desired to be employed which already has four upstanding sidewalls and a bottom already attached to the upstanding four sidewalls as well as an open top, the prior art loading devices would not be generally satisfactory. In particular, although this could be attempted using the prior art devices, in the case of yeast cakes, the shallowness of the box would hinder a vertical placement of a group of rows and columns of yeast cakes since upon retraction of the pusher rod, the forces of gravity and slight vibrations would tend to cause the yeast cakes to fall out of the relatively shallow container.

When it is desired to load articles having relatively shallow heights as compared to their widths and lengths, they cannot easily be handled using conventional equipment. Furthermore, when relatively delicate or crumbly articles are to be loaded, it is especially desirable that sudden forceful movements of the articles be avoided. Where it is desired to load a group of rows and columns of articles into an open container having upstanding side walls, sudden dropping of the articles is also to be avoided since this may result in tumbling of the articles thereby rendering them uneven and unsuitable for shipment, or it may result in deformation or crumbling of the articles due to their low compressive strength. Typical of the loading devices for handling bricks using relatively complex equipment is the type disclosed by Brown, Jr., in U.S. Pat. No. 3,669,283.

Brown discloses a method and apparatus for dehacking brick, in which brick stacked in courses of doublelayer rows are dehacked by sequentially removing complete successive courses from each stack. Successive double-layer rows are removed simultaneously from each pair of courses in the upper layer of each such unit is aligned with a lower unit to form a single-layer line of bricks all having their face sides facing outwardly. A kiln car is used to move stacked courses and rows of bricks toward a car unloading means which has a course-gripping head. A hydraulic ram loads courses, deposited upon input conveyor 14, onto one or the other of conveyors 18,18'. Two pusher assemblies 24,24' are employed for moving the courses loaded by the ram 22 onto conveyors 18,18'. The courses are received by a discharge platform 26, and two row-clamping assemblies 28,30 are sequentially engageable with the bricks deposited on platform 26. However, at no time is a course of bricks moved other than as a unit; for example, no bricks of a course are tilted with respect to other bricks so that a gentle, orderly drop occurs in elevation between a given brick in a course and any other given brick in a course.

Other types of discrete-article handling devices are those employing a simpler arrangement of equipment, especially including a ram which is selectively actuated to move articles from one position to another. The articles may be either stacked or in the alternative, organized in rows or columns. Typical of such prior art devices is that to Langen in U.S. Pat. No. 3,923,144; Jones in U.S. Pat. No. 3,837,466; Joa in U.S. Pat. No. 4,141,193; and Bernham, et al in U.S. Pat. No. 4,214,655.

Langen discloses an intermittent load accumulator having a carton loader mechanism 62 which acts as a ram to load accumulated cartons 64 into loading cartons 65. The hydraulic cylinder 68 is used to move an end load pusher 66 reciprocally. In operation, an endless stream of cartons is fed from a conveyor belt moving transverse to the direction of operation of the pusher 66 onto a conveyor belt moving parallel to the direction of pusher 66. A pusher bar 40 having pusher segments 42 pushes accumulated cartons in a direction transverse to the direction of movement of pusher 66 so as to push selected numbers of cartons in front of the pusher 66. The pusher 66 then pushes the predetermined number of cartons into a receptacle 65 which in this case is a cardboard box having open bottom and top ends. However, no verticle drop of any of the selected predetermined number of cartons is employed in the loading operation. Furthermore, a carton having a closed bottom, four upstanding side walls and an open top cannot be used in this arrangement. Furthermore, very light objects such as yeast cakes would tend to be disturbed slightly during all of the pushing operations discussed in the above, and any slight rotation of the yeast cake would prevent a satisfactory loading operation from occurring since the entranceway into the box is severely constrained in the Langen patent.

Jones teaches a brick-handling apparatus in which layers of bricks are stacked into orderly rows and columns of brick. A pusher member 70 is actuated by an air cylinder 72 and operates to move the grouped rows and columns of bricks back to the rear of a platform 50 to make room for other groups of bricks to be removed. Another pusher member 104 is disclosed and is also actuated by an air cylinder. These pushers are generally operated transversely to the main path of conveyance of the bricks. As in the above, there is no teaching of loading a group of bricks such that a difference in elevation exists between a given selected one of the group of bricks and any other selected one of the group of bricks such that a particular one of the bricks is loaded first by being moved through a vertical drop into a receptacle while others of the bricks have not been moved through such a drop completely. Joa discloses a horizontal diaper grouper wherein stacked pads are tipped on end and two stacks are grouped together in a horizontal row or group of pads with the group discharged as a unit into a shipping container. Here, the pusher member actually is a horizontal support for the stacks in one position and bodily moves the stacks through an arc such that the pusher becomes a vertically-oriented member. A horizontal pusher plate 90 having a power cylinder 92 is used to discharge two stacks 14 through a loading funnel 87. A receptacle is employed to receive the stacks having open flaps such that a single side of the box-like receptacle is open. However, as with the above-discussed references, the stacked articles are not moved through a vertical distance into a receptacle having an open top.

Bernham et al teaches an article-handling apparatus especially useful for handling concrete blocks. The concrete blocks are lifted so as to invert them. The blocks are moved about in a group along conveyor belts. A block transfer arm can pivot to a horizontal position over the blocks to pick up the blocks without interference. A block gripping system is shown in FIG. 3 having three steel shoes which are fitted into recesses on each side of the transfer arm 24. A pivotal transfer motion is used. However, as in the above-discussed references, no vertically-downward displacement of any of a selected one of a group of articles to be transferred occurs. In particular, in Bernham et al, the bricks are moved as a single unit and are not loaded into a receptacle having a vertically-downward drop.

SUMMARY OF THE INVENTION

It is accordingly one object of the present invention to provide an improved loading device which is relatively uncomplicated, loads discrete articles into an open-topped receptacle that is inexpensive to fabricate, that can be used to load articles having a relatively low compression strength, and which employs a single reciprocating loading stroke of a ram.

Another object of the invention is to provide an improved loading device for loading discrete articles from a location on a planer support at a first height to a planer support at a second, lower height without tumbling of the articles.

A further object of the invention is to provide an improved loading device having a moveable ram portion and a resiliently bendable surface attached to a stationary horizontal support surface which underlies the ram.

A still further object of the present invention is to provide an improved loading device having a movable ram, an underlying stationary horizontal support surface, a resiliently bendable surface attached at one end of the stationary horizontal support surface, an underlying receptacle having an open top into which discrete articles moved by the ram are received, and a means for moving the receptacle away from the resiliently bendable support surface so that another receptacle can be loaded.

Another further object of the present invention is to provide an improved loading device having a conveyor belt feeding articles aligned in rows and columns in front of a ram having a generally flat surface for contacting a plurality of columns of articles simultaneously, a receptacle having an open top spaced at a predetermined distance below the horizontal support surface supporting said article in contact with said ram, a resiliently bendable support surface attached to one side of the support surface supporting the articles in contact with said ram, the resiliently bendable surface being resiliently bendable under the weight of the articles which are being loaded such that tumbling of the articles does not occur, a means for moving the receptacle in a direction parallel to movement of the ram away from the ram, and a conveyor belt for removing receptacles which have been filled.

Another object of the present invention is to provide an improved loading device for loading yeast cakes into a relatively shallow container in a single layer, twelve yeast cakes being loaded at a given time by a pusher ram, a support surface overlying at least one edge of the container in a loading position, the pusher ram pushing the yeast cakes onto a resiliently bendable surface which yields gradually along its length in a downward direction so that a first row of yeast cakes contacts an edge and a bottom surface of the container first while the last row of yeast cakes remains in contact with the ram and also in contact with the horizontal support surface directly underlying the ram, the ram moving simultaneously with the container away from the horizontal support surface directly underlying the ram so that the last of the yeast cakes is pushed off of the resiliently bendable surface, the ram then returning to its initial position and the resiliently bendable surface resuming its initial inclination coplaner with the top surface of the horizontal support surface underlying the ram.

The improved loading device of the present invention comprises a support surface underlying a pusher ram, the horizontal support surface having attached thereto a resiliently bendable surface which is initially coplanar with the horizontal support surface but which, under the weight of the articles to be loaded, tilts downward by gradually and continuously bending along its length into an open-topped receptacle. The ram pushes the articles across the horizontal support surface and over the resiliently bendable surface which directly overlies a receptacle, the ram then further pushing the articles away from the resiliently bendable support surface together with movement of the receptacle away from the horizontal support surface so that all of the articles to be loaded are pushed off of the resiliently bendable surface. At this point, the ram retracts to its initial position and the resiliently bendable surface returns to a position coplanar with the horizontal support surface. A conveyor belt feeds the articles in orderly rows and columns to a position in front of the ram. A conveyor belt transfers boxes into proper position underlying the resiliently bendable surface and another conveyor belt carries away the loaded receptacles. The resiliently bendable support surface may be a relatively thin sheet which is sufficiently strongly attached to the horizontal support surface to resist separation therefrom during the loading operation. The resiliently bendable surface may be formed of sheet metal, plastic, rubber, strong flexible cardboard, or the like. The resiliently bendable surface may be attached such that a portion thereof overlies the horizontal support surface and clamped thereto, or it may be attached so as to underlie a relatively thin portion of the horizontal support surface and clamped between the thin portion and the underlying horizontal support material. In either case, the weight of the articles to be loaded should be sufficient to deform the resiliently bendable surface along the line of intersection of the furthermost edge portion of the horizontal support surface and the resiliently bendable surface. If the resiliently bendable surface is made of metal, any type of metal may be used, for example bronze, copper, steel, aluminum or the like. If a plastic resiliently bendable surface is used, plastic material such as polyethylene, vinyl resins or its copolymers, modified vinyls, cellulose plastics, polypropylene, or polyolefin resins may be employed so long as resiliently bendable. Other materials having some degree of flexibility and stability may also be used. Furthermore, any means of connection may be used besides clamping, for example, welding, adhesives, stitching using a thread, ultrasonic bonding, or any other known means of attachment. Also, conventional transporting means may be used to move the articles to a position in front of the ram, to move the boxes to a position underlying the resiliently bendable surface and to move the boxes away from the loading position. Furthermore, any known means of transporting the loaded boxes can be used. For example, a conveyor belt arrangement is disclosed. However, other known conveying or transporting devices may be used, including manual operation by pushing and handling, rollers having other pusher rods associated therewith, chutes where the operation of gravity moves the boxed articles, as well as any other devices which can be used to transport articles.

Further details and advantages of the present invention appear from the following description of a preferred embodiment shown schematically in the drawings.

DETAILED DESCRIPTION OF THE INVENTION

Figure 1:
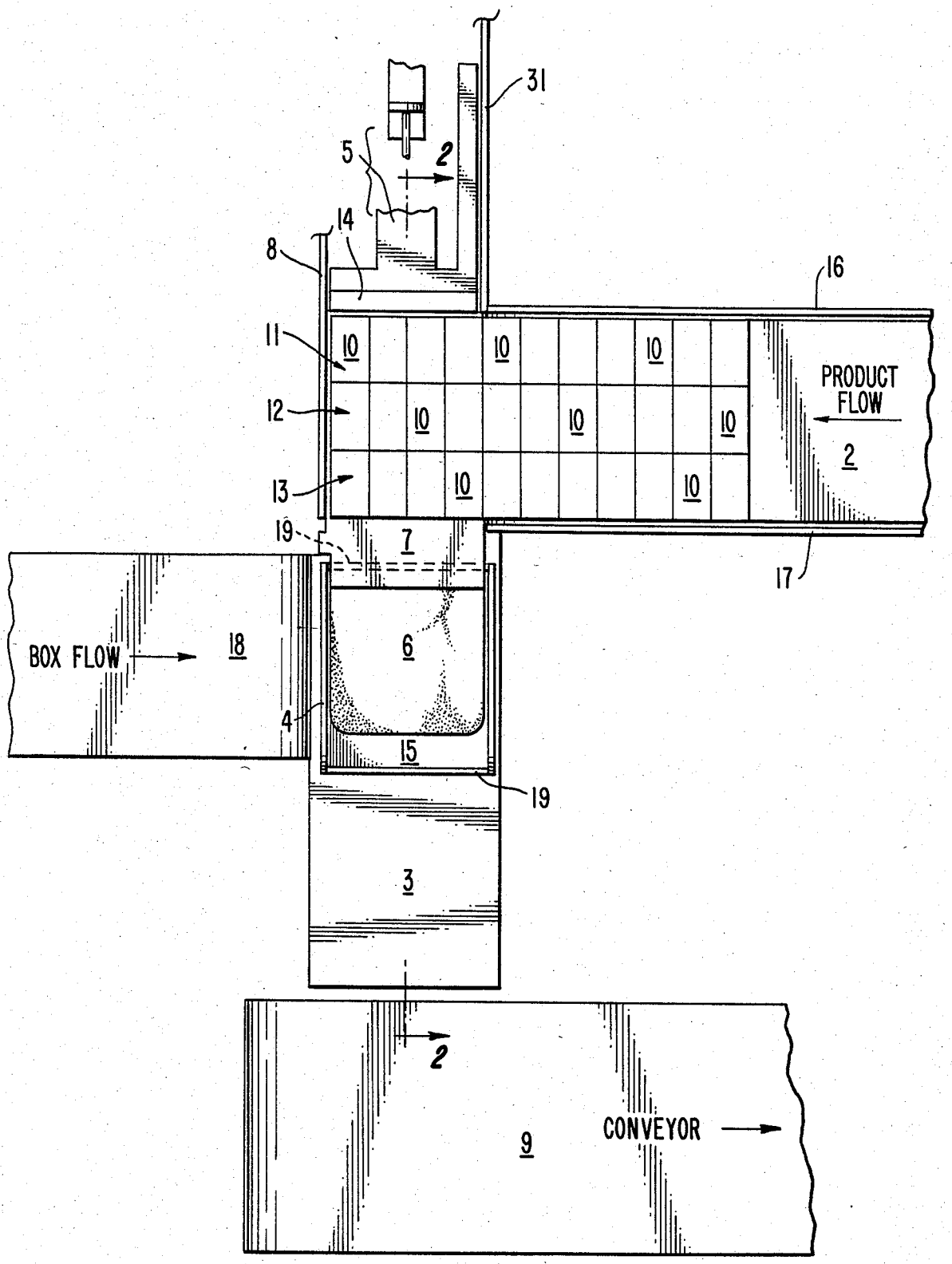
FIG. 1 shows a top elevational view of the yeast cake loading device used in the present invention.

FIG. 1 is a top view of the yeast cake loading device 1 of the present invention. A conveyor belt 2 transports articles 10 which are regular rectangular prismatic solids. The articles 10 are arranged in rows 11,12, and 13. A pair of upstanding guide rails 16,17 guide the articles 10 which are transported by conveyor belt 2. The articles 10 are transported beyond an end of conveyor belt 2 to a position where they overlie a horizontal support surface 7. A T-shaped pusher ram 5 having an enlarged end 14 overlies an edge of the horizontal support surface 7 such that ram end 14 is parallel to the direction of travel of the conveyor belt 2. Another upstanding rail 31, shown in FIG. 1, is optionally placed adjacent the ram 5 to protect workmen from brushing against the ram 5 while it is operating.

The ram 5 is actuated by any known actuating means, such as an air cylinder, hydraulic piston, motor, gear and rack, or the like (not shown). The direction of movement of ram 5 is transverse to the direction of movement of conveyor belt 2. As shown in FIG. 1, rows 11,12, and 13 are accumulated before ram 15 until four columns of articles lie in front of ram head 14. A stop wall 8 prevents further movement of the articles beyond the end of the horizontal article support surface 7. The conveyor belt 2 forces articles 10 across the horizontal support surface 7 by applying a frictional force to the underside of articles 10.

A resiliently bendable support surface 6 is attached to the horizontal article support surface 7. The resiliently bendable support surface 6 is formed generally as a sheet which is attached by any known means to the horizontal article support surface 7. Known means of attaching the resiliently bendable support surface 6 to horizontal surface 7 include ultrasonic bonding, glue, adhesive, stitching with thread, welding, clamping, screws or rivets, or the like. Clamping is the preferred embodiment. The resiliently bendable support surface 6 may be formed of any known material which is flexible, or may be formed as a composite of material at least one of which is flexible at a location near a free edge of horizontal article support surface 7. The resiliently bendable support surface 6 may be formed of any known materials or composites, including metal, plastic, rubber, cellulosic products or the like. If plastic is used, the plastic may be any flexible plastic material such as vinyl resins or its copolymers, modified vinyls, cellulose plastics, polyethylene, polypropylene or polyolefin resins. However, any known plastic, if flexible, may be used as desired.

A horizontal loading support surface 3 underlies all of the resiliently bendable support surface 6 as well as a portion of the free edge of the horizontal article support surface 7. The horizontal loading suppor surface 3 extends further beyond the resiliently bendable support surface 6 in a direction transverse to the direction of travel of conveyor belt 2 and parallel to the direction of travel of the ram 5. The horizontal loading support surface terminates at a conveyor belt 9 which is used to transport loaded receptacles away from the yeast cake loading device of the present invention. The direction of travel of the conveyor belt 9 is opposite to the direction of travel of the conveyor belt 2 in this instance; however, any known means for transporting loading receptacles (such as discussed in the above) away from the loading area may be employed and such is contemplated as being within the scope of the present invention.

A receptacle is shown in FIG. 1 having a bottom 15, upstanding shallow sidewalls 19, a lid 4 oriented in a vertical plane perpendicular to the bottom 15, the receptacle underlying the resiliently bendable support surface 6 and underlying a free edge of the horizontal article support surface 7. The receptacle is supported by the horizontal loading support surface. Receptacles are fed onto the horizontal loading support surface 3 by a conveyor belt 18. A conveyor belt 18 moves in a direction opposite to that of the conveyor belt 2; however, any known means of transporting receptacles (such as discussed in the above) may be used and the direction of transport may be in any direction that does not interfere with the loading operation which is discussed in the following.

Figure 2:
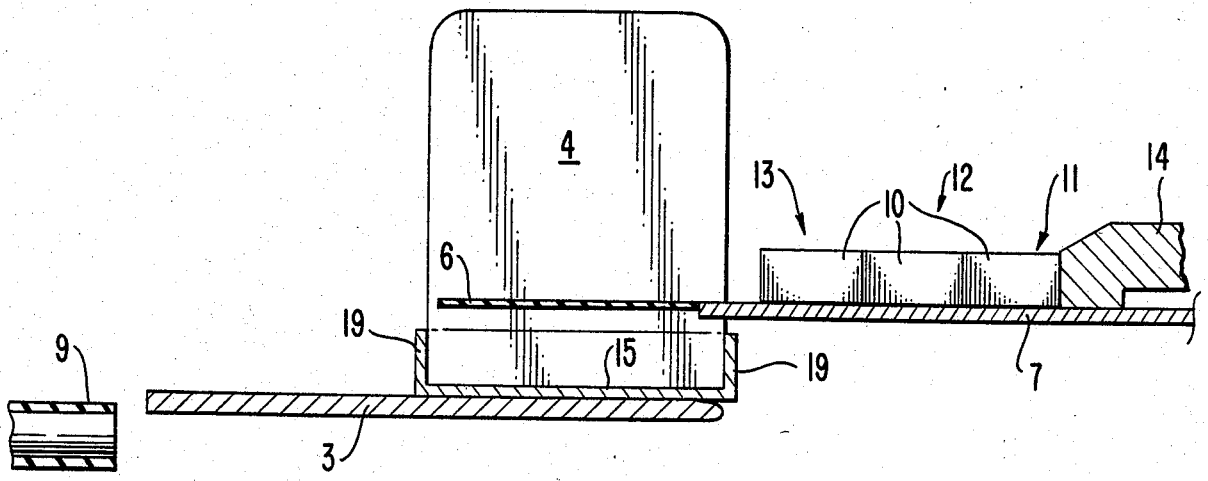
FIG. 2 is a cross-sectional view taken along line 2—2 of FIG. 1 and shows a cross-section of the loading device including a ram, a horizontal support surface, a resiliently bendable support surface, and a receptacle.

FIG. 2 is a side view taken in section along line 2—2 of FIG. 1 and shows clearly the upstanding sidewalls 19 of the receptacle and the receptacle lid 4. An edge view of the resiliently bendable support surface 6 is shown as being generally coplanar with the top surface of the horizontal article support surface 7. A single one of each of the articles 10 in each of rows 11,12, and 13 are shown being supported by the horizontal article support surface 7.

The ram head 14 is in contact with articles 10 in row 11 while articles in row 12 are in directed abutting contact with articles in row 11, and articles 10 in row 13 are in abutting contact with aticles 10 in row 12. The ram 5 is actuated by any known means as discussed in the above, to exert a force to the left in FIG. 2 against row 11 of articles 10.

An edge view of the horizontal loading support surface 3 is shown in FIG. 2. The leftmost edge of the horizontal loading support surface 3 being adjacent a conveyor belt 9 shown in section. Thus, in FIG. 2, the initial position of the yeast cake loading device is shown.

Figure 3:
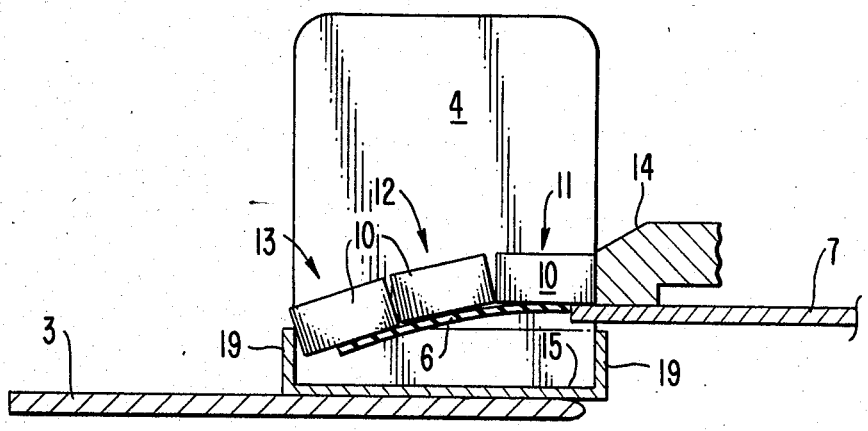
FIG. 3 shows a side view similar to that of FIG. 2 above wherein the ram has moved to push the articles to a position directly overlying the receptacle.

FIG. 3 is a side section view similar to that shown in FIG. 2 above, wherein the ram head 14 of ram 5 has pushed the three rows 11,12,13 of articles 10 to the left such that each of rows 11,12,13 overlies at least a portion of the tiltable support surface 6.

Note that, in FIG. 3, the resiliently bendable support surface 6 is resiliently deformed under the weight of articles 10 such that the leftmost edge in FIG. 3 of the resiliently bendable support surface 6 rests against the bottom 15 of the receptacle. The rightmost edge of the resiliently bendable support surface 6 remains attached to the horizontal article support surface 7. The ram head 14 of ram 5 overlies the leftmost edge of the horizontal article support surface 7 but does not go beyond it.

Figure 4:
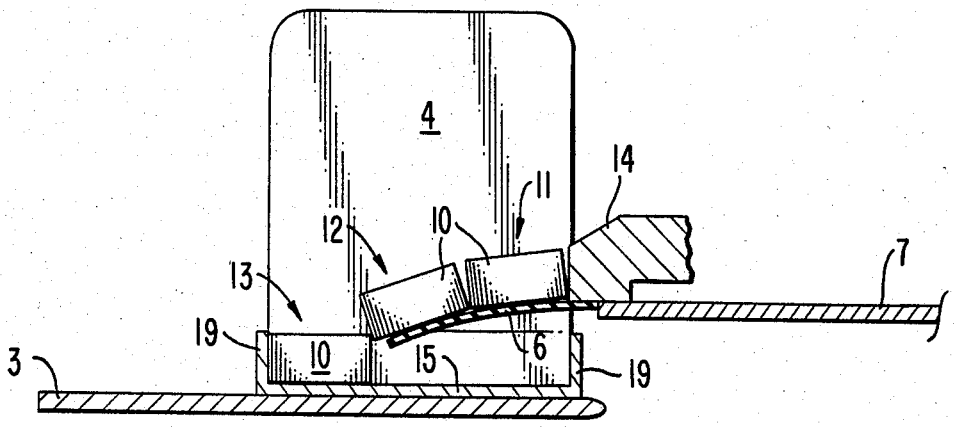
FIG. 4 is a side view similar to that shown in FIG. 3, but wherein the ram has pushed the articles beyond the horizontal support surface.

FIG. 4 shows a side sectional view similar to that shown in FIG. 3 above, wherein the ram head 14 of ram 5 has traveled slightly further to the left and beyond the free edge of the horizontal article support surface 7. Note in FIG. 3 that a top edge of an article 10 in row 13 at the leftmost edge is in contact both with bottom 15 of the receptacle and upstanding wall 19 of the receptacle. Therefore, the further movement of the ram head 14 of ram 5 has caused a horizontal translation of the entire receptacle toward the left by an amount roughly equal to the distance traveled to the left by ram head 14 from the position shown in the FIG. 3 to the position shown in FIG. 4.

FIG. 4 shows that, in the translated position of the receptacle, articles 10 in row 13 no longer overlie the resiliently bendable support surface 6. Furthermore, articles 10 in row 13 lie flat against the bottom surface 15 of the receptacle. Articles 10 in remaining rows 11,12 still overlie the resiliently bendable support surface 6. Since the resiliently bendable support surface 6 lies at an angle inclined downward under the weight of articles 10 in rows 11 and 12, the articles in rows 11 and 12 are tilted and are not in contact with the bottom 15 of the receptacle. The point of contact of the ram head 14 with the articles 10 in row 11 is no longer flush contact but rather the lowermost edge of the ram head 14 contacts an intermediate portion of the rightmost surface of articles 10 in row 11.

Figure 5:
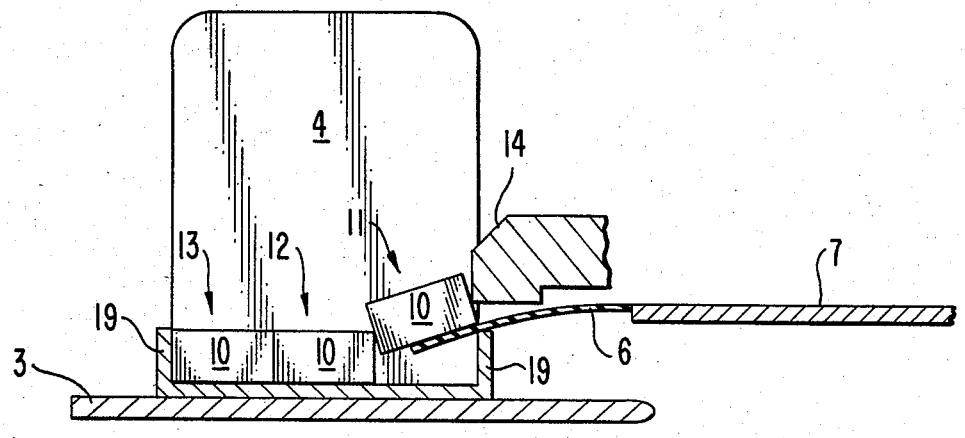
FIG. 5 is a side view similar to that shown in FIG. 4 above, but wherein the ram has pushed all but the last of the atticles to be loaded beyond the resiliently bendable surface.

In FIG. 5 is shown a side sectional view similar to that shown in FIG. 4 above. Here, the receptacle is shown having been moved even further to the left than in FIG. 4. A single row 11 of articles 10 remains supported at least partially by the resiliently bendable support surface 6 at a righthand portion as shown in FIG. 5. The row 11 of articles 10 is also partially supported at its leftmost end by articles 10 in row 12. Thus, further movement of ram 14 causes a force acting through articles 10 in rows 11,12,13 to the leftmost upstanding sidewall 19 of the receptacle and causes further movement of the receptacle.

Two rows 11,13 of articles 10 both lie flush against the bottom 15 of the receptacle, with the leftmost edge of articles 10 row 13 lying flush against the upstanding leftmost sidewall 19 of the receptacle. The entire receptacle still overlies the horizontal loading support surface 3 such that no portion of the receptacle projects beyond any edge of the horizontal loading support surface 3. Note that the ram head 14 of ram 5 overlies the resiliently bendable support surface 6 in this position, the resiliently bendable support surface 6 being deformed under the weight of articles 10 of row 11 with the deformation downward limited by the rightmost upstanding sidewall 19. As seen in FIG. 5, the lower surface of the resiliently bendable support surface 6 lies in contact with the top edge of the upstanding rightmost sidewall 19 of the receptacle.

Figure 6:
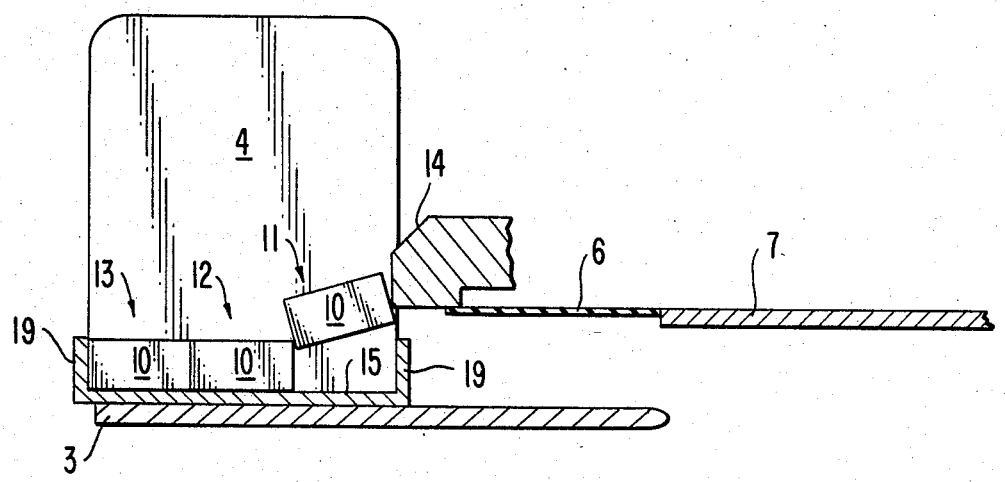
FIG. 6 is a side view similar to that shown in FIG. 5 above, but wherein the last of the yeast cakes has been pushed beyond the resiliently bendable support surface and the ram has pushed the entire receptacle from beneath the resiliently bendable support surface.

FIG. 6 shows the position of the receptacle and ram and is a sectional side view similar to that shown in FIG. 5. In FIG. 6 the receptacle has been moved further to the left such that its leftmost edge lies beyond the leftmost edge of the horizontal loading support surface 3. In this position, the ram head 14 of ram 5 lies completely beyond the leftmost edge of the resiliently bendable support surface 6.

The ram head 14 of ram 5 remains in contact with row 11 of articles 10 such that force is transmitted from the articles 10 of row 11 to the leftmost upstanding sidewall 19 and receptacle interior 15 through articles 10 of rows 12,13. As in FIG. 5, articles 10 in rows 12,13 lie flush with bottom surface 15 of the receptacle, and the leftmost edge of articles 10 of row 13 lies flush in contact with the leftmost upstanding sidewall 19 of the receptacle. The leftmost portion of the receptacle, in particular leftmost upstanding sidewall 19, extends beyond the leftmost edge of the horizontal loading support surface 3. The center of gravity of the receptacle remains over the horizontal loading support surface 3. As the weight of articles 10 of row 11 has now been removed from the resiliently bendable support surface 6, the resiliently bendable support surface 6 has returned to a completely horizontal position, coplanar with that of the horizontal article support surface 7 due to the resiliency at the juncture between the resiliently bendable support surface 6 and the horizontal article support surface 7.

Figure 7:
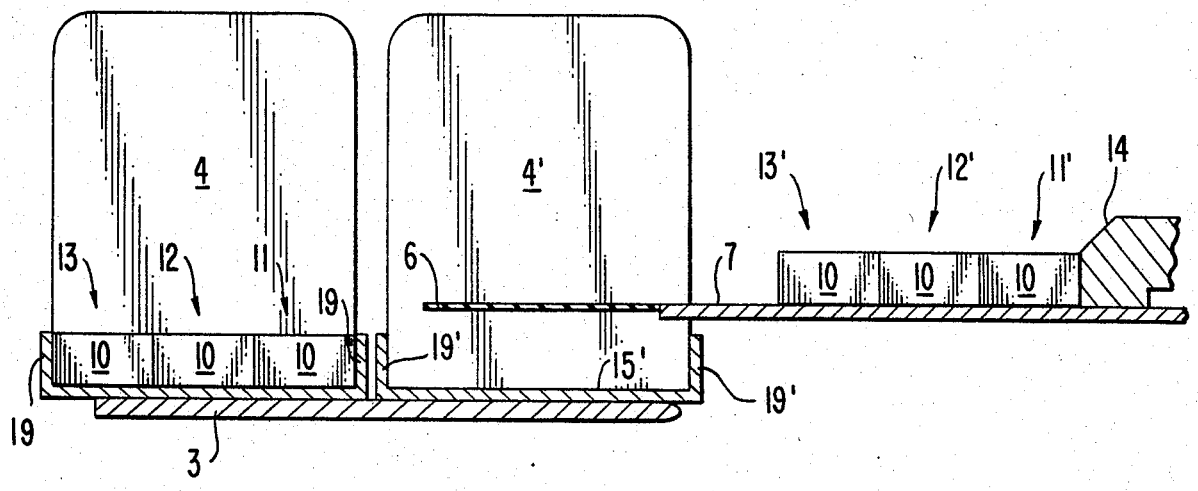
FIG. 7 is a side view similar to that shown in FIG. 6 above, but with the ram returned to its initial position, other articles to be loaded moved in front of the ram, and a new receptacle to be loaded moved beneath the resiliently bendable surface.

FIG. 7 is a side cross-sectional view similar to that shown in FIG. 6 with a second, empty receptacle ready for loading. The ram head 14 has been retracted to its initial position to the right of articles 10' in row 11'. The resiliently bendable support surface 6 is in a horizontal position coplanar with the upper surface of the horizontal article support surface 7. The filled receptacle, as described in FIGS. 2–6, remains in the position shown in FIG. 6. However, all of the articles 10 in rows 11,12,13 lie flush along the bottom surface 15 of the receptacle. The articles 10 in rows 11,12,13 substantially fill the space between upstanding sidewalls 19,19.

A second receptacle having upstanding sidewalls 19',19', a receptacle lid 4' and a receptacle bottom surface 15', has been placed under the resiliently bendable support surface 6 with the rightmost upstanding sidewall 19' underlying a leftmost portion of the horizontal article support surface 7, the same position occupied by the receptacle in FIG. 2 which receptacle is now shown as being filled in FIG. 7. The empty receptacle shown in FIG. 7 was fed to the yeast cake loading device by a conveyor belt 18. Nonetheless, any article transporting means may be used instead of a conveyor belt, for example, manual loading, a chute having a lower elevation and a higher elevation, a pneumatically-actuated piston and loader device, or any other known transporting means.

Figure 8:
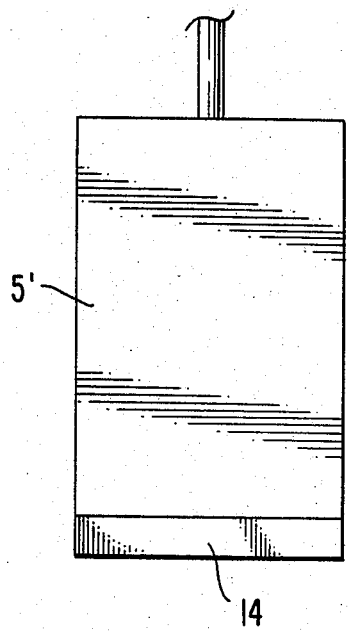
FIG. 8 is a top elevational view of al alternative embodiment of a ram.

FIG. 8 is a top elevational view of an alternative embodiment of a ram. The ram 5' of FIG. 8 is rectangular in outline and presents a solid surface along its sides during reciprocating movement of the ram 5'. The solid side on the righthand side of ram 5' stops further movement of articles 10 along the conveyor belt 2 while the ram 5' is being operated toward its furthest extension during the loading operation.

Figure 9:
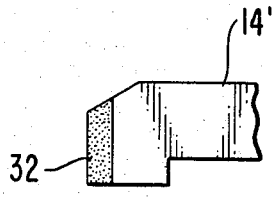
FIG. 9 is a side view of an alternative embodiment of a ram head having a resilient facing material.

FIG. 9 is a side view of an alternative embodiment of a ram head 14'. The ram head 14' has a resilient facing 32 attached thereto. The resilient facing 32 may be rubber, resilient plastic, foamed rubber or plastic, wood, wire wool, or any other resilient material. The resilient facing 32 may be attached to the ram head 14' by any conventional attaching means, for example by gluing, ultrasonic bonding, clamping, bolting, magnetic attraction (for a composite resilient facing 32 having iron or a magnet incorporated therein), or the like.

Figure 10:
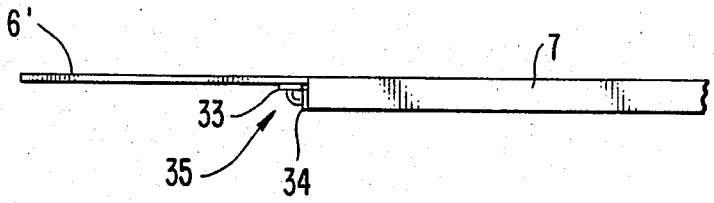
FIG. 10 is a side view of an alternative embodiment.

FIG. 10 is a side view of an alternative support surface 6'. In this embodiment, the surpport surface 6' is relatively stiff and is tiltable relative to the support surface 7 about a spring-loaded hinge 35. The spring-loaded hinge 35 has two leaves. A first leaf 33 is fixedly attached to the support surface 6', as by gluing, welding, ultrasonic bonding or the like. A second leaf 34 is fixedly attached to the support 7.

Thus the support surfaces 6' and 7 are hingedly connected such that the relatively stiff surface 6' can pivot downward about the spring-loaded hinge 35. The shelf 6' then would operate in very similar fashion to the operation of shelf 6 as shown in FIGS. 1–7, except that shelf 6' would not resiliently deform, but rather the spring-loaded hinge will resiliently fold under the weight of the articles 10.

Figure 11:
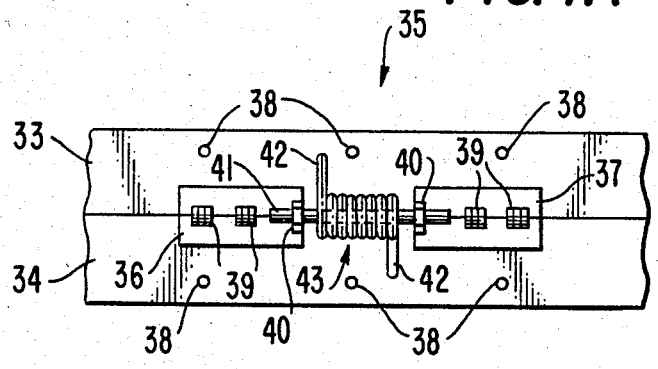
FIG. 11 is a plan view of the hinge shown in FIG. 10.

FIG. 11 is a schematic plan view of the spring-loaded hinge 35 with the parts lying flat prior to assembly with members 6' and 7. Leaves 33 and 34 are connected by hinges 36,37. The hinges 36,37 are conventional hinges such as are used in jewelry, fine cabinets, and the like. Although particular hinges are shown having pin-and-sleave pivot elements 39, any type of conventional hinge elements may be used; for example, a plastic "living hinge" or a Velcro® hinge could be used instead.

A spring 43 is used to resiliently bias the relatively rigid shelf 6' to a horizontal position as seen in FIG. 10. The shelf 6' is stopped from further upward movement due to abutting contact with the support 7. The abutting contact may be adjusted by shims placed at the point of contact of support surfaces 6' and 7.

FIG. 11 is plan view of the hinge 35 of FIG. 10, shown in plan view in a flattened condition prior to assembly to the support surfaces 6′ and 7. The leaves 33 and 34 have mounting holes 38 therein. A smaller, connecting pair of hinges 36,37 hold the leaves 33,34 together in pivotal contact. A helical spring 43 is coiled and has two free ends 42,42 in contact with leaves 33,34 to urge them apart. The strength of the spring 43 is selected as to be just sufficiently strong to bias the support surface 6′ to the level position shown in FIG. 10, and yet not be so strong as to prevent downward deflection of the shelf 6′ under the weight of the articles 10 to be loaded.

A rod 41 anchors the spring 43 to leaf 33 by attachment nuts 40,40. The spring 43 is freely pivotable about the rod 41.

Although a group of articles 10 is shown in FIG. 1 as being four across and three deep, any number of articles across may be simultaneously loaded as this is determined by scaling up or down in dimension the ram 5, shelf 6, and receptacle 15. Also, any number of articles may be loaded in depth by scaling up or down the length of the stroke of the ram 5, the length of shelf 6, and the length of the receptacle 15.

In operation, articles 10 are fed by a conveyor belt 2 into a loading position in front of a ram head 14 of a ram 5. A stop member 8, which may be an upstanding wall in a preferred embodiment, prevents motion of articles 10 beyond the wall 8. The conveyor belt 2 terminates at a point just to the right of a horizontal article support surface 7. The horizontal article support surface 7 lies completely under the path traveled by the ram head 14 and is adapted to permit sliding movement of articles 10 across it.

When a sufficient number of articles 10 have been accumulated in rows 11,12,13, and a receptacle has been positioned under the resiliently bendable support surface 6 and on top of the horizontal loading support surface 3, the loading sequence begins. The ram head 14 of ram 5, actuated by a pneumatic cylinder or an electromotor device, pushes the articles 10 down in FIG. 1 and left in FIGS. 2–7) so that the articles 10 are pushed beyond the free edge of the horizontal article support surface 7 and onto the resiliently bendable support surface 6.

The weight of the articles 10 on the resiliently bendable support surface 6 causes the resiliently bendable support surface 6 to flexibly, resiliently bend near the junction of the resiliently bendable support surface 6 and the horizontal article support surface 7. The downward deflection of the resiliently bendable support surface 6 is limited only by the contact of the resiliently bendable support surface 6 with the receptacle bottom 15. The resiliently bendable support surface 6 need not be completely planar, for example, an irregular or nonplanar support surface could be used as well so long as the resiliently bendable support surface 6 was resilient; such could be accomplished by, for example, gluing a rubber or plastic sheet to the top of the horizontal article support surface 7 and also gluing onto that resilient sheet any other flexible sheet having the desired shape or surface characteristics to be used for a resiliently bendable support surface 6. Nonetheless, in a preferred embodiment, the resiliently bendable support surface 6 is a planar article which is fastened to the upper surface of the horizontal article support surface 7 and the entire resiliently bendable support surface 6 is of a uniform material. A generally smooth upper surface of the resiliently bendable support surface 6 is preferred. Nonetheless a roughened, irregular, or channeled upper region may be formed on the upper portion of resiliently bendable support surface 6 as may be desired; such is within the intended scope of the present invention.

The ram head 14 of ram 5 further pushes the articles 10 beyond the leftmost edge of the horizontal article support surface 7 and onto the resiliently bendable support surface 6 such that the resiliently bendable support surface 6 is completely covered by the articles 10. The resiliently bendable support surface 6 bends resiliently downward until its leftmost edge rests upon the bottom 15 of the receptacle and the upper, leftmost edge of articles 10 in row 13 abut the leftmost upstanding sidewall 19 of the receptacle. Further movement to the left in FIGS. 2–7 of the ram head 14 causes motion to be transmitted through rows 11,12,13 of articles 10 to the receptacle by way of the leftmost upstanding sidewall 19. Therefore, as seen in the figures, further movement of the ram head 14 causes first articles 10 of row 13 to be pushed beyond the leftmost edge of the resiliently bendable support surface 6 as shown in FIG. 4.

Further movement of the ram head 14 pushes articles 10 in row 12 off of the resiliently bendable support surface 6 and further moves the receptacle to the left accordingly. Thus, at this point, articles 10 in rows 12 and 13 lie flush with the bottom surface 15 of the receptacle and articles 10 in row 11 lie at the leftmost edge of the resiliently bendable support surface 6; at this point, downward deflection of the resiliently bendable support surface 6 is limited by the rightmost upstanding sidewall 19 of the receptacle.

Further leftward movement of the ram head 14 results in articles 10 of row 11 being completely removed from the resiliently bendable support surface 6. The resiliently bendable support surface 6 then resiliently reassumes its initial horizontal position coplanar with the horizontal article support surface 7. The receptacle is now sufficiently far away from the resiliently bendable support surface 6 so as to permit an empty receptacle to be inserted in the identical location which was originally occupied by the now-filled receptacle at the start of the loading operation shown in FIG. 2. Upon filling of this second receptacle, a third receptacle would then be inserted beneath the resiliently bendable support surface 6 and then a fourth and a fifth and so on. As each receptacle is filled in turn, movement of the ram in further loading operations pushes that receptacle being loaded as well as the previously-loaded receptacle to the left in FIGS. 2–7 such that the receptacles then overlie a conveyor belt 9, as shown in FIG. 1. The conveyor belt transports the filled receptacles to another station for further processing. Nonetheless, instead of a conveyor belt 9, any transporting means may be used, including manual loading, a chute arrangement, a rack and pinion transporting device, or may even include any other known means since such is not critical to the present invention.

The receptacle need not have a folding lid 4 but may be any open-topped receptacle having no lid, or a plurality of flaps which may be used to form a lid, or any other arrangement. Also, the receptacle need not be rectangular but may be oval, circular, hexagonal, pentagonal or the like. A rectangular receptacle having generally rectangular articles which are yeast cakes is shown as a preferred embodiment of the invention. Nonetheless, hexagonal objects to be loaded into a hexagonal receptacle or any other shaped receptacle is within the scope of the present invention.

The articles 10 are shown as being regular rectangular prismatic solids. Nonetheless, such articles may be disk- or puck-shaped articles or may have any regular or irregular shape so long as they are capable of being pushed by a ram head 14 and are capable of sliding across a horizontal article support surface 7 and into a receptacle. The articles 10 of the preferred embodiment of the present invention are yeast cakes, nonetheless, any other articles may be used including bricks, disks, packages or cartons, and the like.

The improved yeast cake loading device of the present invention is capable of achieving the above-enumerated objects and while preferred embodiments of the present invention have been disclosed, it will be understood that it is not limited thereto but may be otherwise embodied within the scope of the following claims.

We claim:

1. A loading device for loading articles comprising in combination:

an open-topped receptable having an upstanding end wall and upstanding side walls; said upstanding end wall having a predetermined height;

a ram adapted for pushing articles across a surface;

a means for moving said ram;

a horizontal article support surface adapted for slideably supporting articles;

a resiliently bendable support member having a free end which is cantilevered from a support end of said horizontal article support surface, said free end being adapted to resiliently move downwardly toward an open receptacle; said free end of said resiliently bendable support member having a height above a horizontal loading support surface;

the horizontal loading support surface adapted to support said open-topped receptacle thereon; said horizontal loading support surface underlying said resiliently bendable support surface;

said resiliently bendable support member being resiliently bent during operation of said ram by the weight of articles moved by said ram onto said resiliently bendable support member, such that the articles are lowered during operation of said ram from said horizontal article support surface by said resiliently bendable support member to said open-topped receptacle underlying said resiliently bendable support member;

said open-topped receptacle having an upstanding front wall; said upstanding front wall having a front wall height; in an initial position, said open-topped receptacle is disposed beneath said resiliently bendable support member with said upstanding end wall lying beyond a vertical plane containing said free end of said resiliently bendable support member, said open-topped member being connected with said upstanding front wall underlying said resiliently bendable support member; in said initial condition said resiliently bendable support member having no articles thereon, and said ram being retracted;

in a second condition, said ram is extended toward said support end of said horizontal article support surface, pushing articles from said horizontal article support surface onto said resiliently bendable support member; said free end of said resiliently bendable support member moving downwardly under the weight of the articles below said height of said upstanding end wall; in said second condition a portion of at least one of the articles is in abutting relationship with said upstanding end wall;

in a third condition, said at least one of the articles is moved under action of said ram, causing movement of said open-topped receptacle in a direction generally parallel to said ram; the articles being pushed off of said resiliently bendable support member by said ram, removal of the articles from said resiliently bendable support member gradually increasing the height of said resiliently bendable support member above said horizontal loading support surface of said free end of said resiliently bendable support member;

whereby articles pushed by said ram across said resiliently bendable support member are lowered under their own weight by said resiliently bendable support member into said open-topped receptacle.

2. A loading device as claimed in claim 1 wherein said resiliently bendable support surface in an undeformed condition lies in generally the same plane as said horizontal article support surface;

whereby the ram can push articles across said horizontal article support surface and toward resiliently bendable support member.

3. A loading device as claimed in claim 1 further comprising a means for conveying articles to said horizontal article support surface.

4. A loading device as claimed in claim 1, wherein sufficient articles are accumulated on said horizontal article support surface so that operation of said ram substantially fills a receptable with articles during a single stroke thereof.

5. A loading device as claimed in claim 4 wherein said receptacle has a bottom sidewall;

said receptacle having an open top having a width which exceeds the width of said resiliently bendable support member;

whereby during a loading operation of said free end of said resiliently bendable support member descends into said open top of said receptacle.

6. A loading device as claimed in claim 5 further comprising a means for conveying articles to said horizontal support surface;

whereby at least a portion of the plurality of articles can be positioned on said horizontal support surface for pushing by said ram.

7. A loading device as claimed in claim 5 further comprising a means for conveying receptacles to a position beneath said resiliently bendable support such that said receptacles lie upon said horizontal loading support surface;

whereby receptacles are provided for loading at least a portion of the plurality of articles during a loading operation.

8. A loading device as claimed in claim 5 further comprising a means for conveying receptacles away from said horizontal loading support surface;

whereby filled receptacles are removed from said horizontal loading support surface to provide an open area for another loading operation.

9. A loading device as claimed in claim 5 further comprising:

a means for conveying articles to said horizontal support surface;

a means for conveying receptacles to a location underlying said resiliently bendable support, said location overlying said horizontal loading support surface; and a means for conveying filled receptacles away from said horizontal loading support surface;

whereby the plurality of articles are supplied to said horizontal support surface for accumulation and for pushing by said ram, an empty receptacle being conveyed to a loading position under said resiliently bendable support, and filled receptacles are conveyed away from said horizontal loading support surface, so that a continuous loading operation is conducted.

10. A loading device as claimed in claim 1 wherein said receptacle is an open-topped box.

11. A loading device as claimed in claim 1 wherein the plurality of articles comprise regular rectangular prismatic articles;

at least a portion of the plurality of articles being arranged in rows and columns adjacent said ram head for loading;

whereby a single stroke of said ram acts upon said at least a portion of the plurality of said articles so as to fill said receptacle.

12. A loading device as claimed in claim 11 wherein the plurality of articles comprise yeast cakes.

13. A loading device as claimed in claim 12 wherein said yeast cakes lie in a single layer in front of said ram head, and are loaded in a single layer into said receptacle.

14. A loading device as claimed in claim 11 wherein said ram head has a generally planar leading surface adapted to abut at least a portion of the plurality of articles;

said at least a portion of the plurality of articles being arranged in rows and columns such that a generally planar contact surface is presented to said ram head;

said ram being adapted to move in a direction substantially perpendicular to said generally planar leading surface of said ram head to push said at least a portion of said plurality of articles;

said ram head being adapted to travel across said horizontal article support surface and further across said resiliently bendable support and slightly beyond, so that all of said at least a portion of said plurality of articles is removed from said horizontal article support surface and said resiliently bendable support by movement of said ram;

whereby said receptacle is loaded by movement of said ram head.

15. A loading device as claimed in claim 5 wherein said resiliently bendable support comprises a relatively thin, planar sheet of resilient material;

said resiliently bendable support being adapted to lie in substantially a coplanar relationship with said horizontal support surface when no articles overlie said resiliently bendable support;

said resiliently bendable support being adapted to resiliently bend under the weight of at least one article in a downward direction;

whereby a smooth downward transition is made by an article from said horizontal support surface to said receptacle.

16. A loading device as claimed in claim 5 further comprising:

a means for conveying articles to said horizontal support surface;

a means for conveying receptacles to a location underlying said tiltable support, said location overlying said horizontal loading support surface; and a means for conveying filled receptacles away from said horizontal loading support surface;

whereby the plurality of articles are supplied to said horizontal support surface for accumulation and for pushing by said ram, an empty receptacle being conveyed to a loading position under said tiltable support, and filled receptacle being coveyed away from said horizontal loading support surface, so that a continuous loading operation is conducted.

17. A loading device for loading articles comprising in combination:

an open-topped receptacle having an upstanding end wall and upstanding side walls;

a horizontal supporting surface adapted to slideably support a plurality of articles;

a horizontal loading support surface adapted to supp6rt said open-topped receptacle thereon; said horizontal loading support surface underlying said resiliently bendable support surface;

a ram adapted for pushing articles across said horizontal support surface, said ram having a ram head for contacting the articles;

a means for moving said ram to push at least some of the plurality of articles across said horizontal support surface;

a resiliently bendable support member which is cantilevered from a first edge of said horizontal support surface;

a means for resiliently biasing said resiliently bendable support member to a level position with said horizontal support surface;

said resiliently bendable support member being adapted to tilt downward at a free end while another end of said resiliently bendable support member remains connected to said horizontal support surface;

said ram being located along a second portion of said horizontal support surface, said ram being adapted for linear movement across said horizontal support surface toward said resiliently bendable support member;

said resiliently bendable support member being resiliently bent during operation of said ram by the weight of articles moved by said ram onto said resiliently bendable support member, such that the articles are lowered during operation of said ram from said horizontal article support surface by said resiliently bendable support member to said open-topped receptacle underlying said resiliently bendable support member;

said open-topped receptacle having an upstanding front wall; said upstanding front wall having a front wall height; in an initial position, said open-topped receptacle is disposed beneath said resiliently bendable support member with said upstanding end wall lying beyond a vertical plane containing said free end of said resiliently bendable support member, said open-topped member being connected with said upstanding front wall underlying said resiliently bendable support member; in said initial condition said resiliently bendable support member having no articles thereon, and said ram being retracted;

in a second condition, said ram is extended toward said support end of said horizontal article support surface, pushing articles from said horizontal article support surface onto said resiliently bendable support member; said free end of said resiliently bendable support member moving downwardly under the weight of the articles below said height of said upstanding end wall; in said second condition a portion of at least one of the articles is in abutting relationship with said upstanding end wall;

in a third condition, said at least one of the articles is moved under action of said ram, causing movement of said open-topped receptacle in a direction generally parallel to said ram; the articles being pushed off of said resiliently bendable support member by said ram, removal of the articles from said resiliently bendable support member gradually increasing the height of said resiliently bendable support member above said horizontal loading support surface of said free end of said resiliently bendable support member;

whereby the articles are pushed by said ram across said horizontal support surface and onto said resiliently bendable support member so that articles overlying said free end of said resiliently bendable support member are lowered.

18. A loading device as claimed in claim 17, wherein said receptacle has a bottom and upstanding sidewalls;

said receptacle having an open top having a width which exceeds the width of said tiltable support;

whereby during a loading operation said free end of said tiltable support descends into said bottom of said receptacle.

19. A loading device as claimed in claim 18 further comprising a means for conveying articles to said horizontal support surface;

whereby at least a portion of the plurality of articles can be positioned on said horizontal support surface for pushing by said ram.

20. A loading device as claimed in claim 18 further comprising a means for conveying receptacles to a position beneath said tiltable support such that said receptacles lie upon said horizontal loading support surface;

whereby receptacles are provided for loading at least a portion of the plurality of articles during a loading operation.

21. A loading device as claimed in claim 18 further comprising a means for conveying receptacles away from said horizontal loading support surface;

whereby filled receptacles are removed from said horizontal loading support surface to provide an open area for receiving an unfilled receptacle for another loading operation.

22. A loading device as claimed in claim 18, wherein said means for resiliently biasing said tiltable support comprises a resiliently deformable member acting between said horizontal support surface and said tiltable support;

said tiltable support being relatively rigid;

said means for resiliently biasing said tiltable support being sufficiently strong to bias said tiltable support to a position level with said horizontal support surface in an unloaded condition, and adapted to be deformable under the additional weight of any articles overlying said tiltable support;

whereby said free end of said tiltable support is displaced in a downward direction under the weight of at least an article lying upon said tiltable support so that further pushing by said ram initially deposits at least a portion of the plurality of the articles against said bottom and against at least one said upstanding sidewall so as to transmit force between said ram and said upstanding sidewall to move said receptacle in the same direction as the movement of said ram, and whereby further movement of said ram causes all of the contacting portion of the plurality of articles to be deposited within said receptacle whereupon when empty said tiltable support returns to an initial position generally level with said horizontal support surface, said receptacle having been moved a sufficient distance from under said tiltable support to permit sufficient room for an empty receptacle to be placed therein.

23. A loading device as claimed in claim 17, wherein said receptacle is an open-topped box.

24. A loading device as claimed in claim 18, wherein said resiliently biasing member is a helical spring having two free ends;

a first leaf connected to said spring, and a second leaf which is hinged to said first leaf;

said spring being adapted to resiliently bias apart said first leaf and said second leaf;

whereby said tiltable support and said horizontal support surface are resiliently biased toward a level position.

25. A loading device as claimed in claim 18, wherein said tiltable support comprises a relatively thin, planar sheet of relatively rigid material;

said tiltable support being adapted to lie in substantially a coplanar relationship with said horizontal support surface when no articles overlie said tiltable support;

said tiltable support being adapted to be displaced about said other end under the weight of at least one article such that said free end is displaced downwardly;

whereby a smooth, downward transition is made by an article from said horizontal support surface to said receptacle.

26. A loading device for loading articles comprising in combination:

an open-topped receptacle having an upstanding end wall and upstanding side walls;

a horizontal support surface adapted for slideably supporting a plurality of articles;

a horizontal loading support surface adapted to support said open-topped receptacle thereon; said horizontal loading support surface underlying said resiliently bendable support surface;

a ram adapted for pushing articles across said horizontal support surface, said ram having a ram head for contacting the articles;

a means for moving said ram to push at least some of the plurality of articles across said horizontal support surface;

a resiliently bendable support member having a free end which is cantilevered from a support end of said horizontal support surface;

said resiliently bendable support member being adapted to resiliently bend downward continuously from an end cantilevered from said support end to its said free end said ram being located along a second portion of said horizontal support surface, said ram having a linear movement across said horizontal support surface toward said resiliently bendable support member;

said free end of said resiliently bendable support member having a height above said horizontal loading support surface;

said resiliently bendable support member being resiliently bent during operation of said ram by the weight of articles moved by said ram onto said resiliently bendable support member, such that the articles are lowered during operation of said ram from said horizontal article support surface by said resiliently bendable support member to said open-topped receptacle underlying said resiliently bendable support member;

said open-topped receptacle having an upstanding front wall; said upstanding front wall having a front wall height; in an initial position, said open-topped receptacle is disposed beneath said resiliently bendable support member with said upstanding end wall lying beyond a vertical plane containing said free end of said resiliently bendable support member, said open-topped member being connected with said upstanding front wall underlying said resiliently bendable support member; in said initial condition said resiliently bendable support member having no articles thereon, and said ram being retracted;

in a second condition, said ram is extending toward said support end of said horizontal article support surface, pushing articles from said horizontal article support surface onto said resiliently bendable support member; said free end of said resiliently bendable support member moving downwardly under the weight of the articles below said height of said upstanding end wall; in said second condition a portion of at least one of the articles is in abutting relationship with said upstanding end wall;

in a third condition, said at least one of the articles is moved under action of said ram, causing movement of said open-topped receptacle in a direction generally parallel to said ram; the articles being pushed off of said resiliently bendable support member by said ram, removal of the articles from said resiliently bendable support member gradually increasing the height of said resiliently bendable support member above said horizontal loading support surface of said free end of said resiliently bendable support member;

whereby articles are pushed by said ram across said horizontal support surface and onto said resiliently bendable support member so that articles overlying said free end of said resiliently bendable support member are lowered.

* * * * *